US011566482B2

(12) United States Patent
Langeland

(10) Patent No.: US 11,566,482 B2
(45) Date of Patent: Jan. 31, 2023

(54) WELL TOOL

(71) Applicant: Swarfix AS, Sandnes (NO)

(72) Inventor: Geir Magne Langeland, Ålesund (NO)

(73) Assignee: Swarfix AS, Sandnes (NO)

( * ) Notice: Subject to any disclaimer, the term of this patent is extended or adjusted under 35 U.S.C. 154(b) by 0 days.

(21) Appl. No.: 17/276,704

(22) PCT Filed: Sep. 10, 2019

(86) PCT No.: PCT/EP2019/074080
§ 371 (c)(1),
(2) Date: Mar. 16, 2021

(87) PCT Pub. No.: WO2020/058039
PCT Pub. Date: Mar. 26, 2020

(65) Prior Publication Data

US 2022/0025726 A1 Jan. 27, 2022
US 2022/0372827 A9 Nov. 24, 2022

(30) Foreign Application Priority Data

Sep. 17, 2018 (NO) ..... 20181205

(51) Int. Cl.
*E21B 27/04* (2006.01)
*E21B 23/04* (2006.01)
(Continued)

(52) U.S. Cl.
CPC ..... *E21B 27/04* (2013.01); *E21B 23/01* (2013.01); *E21B 23/0411* (2020.05); *E21B 31/06* (2013.01); *E21B 37/04* (2013.01)

(58) Field of Classification Search
CPC ..... E21B 31/06; E21B 27/04; E21B 23/0411
See application file for complete search history.

(56) References Cited

U.S. PATENT DOCUMENTS 3,938,598 A * 2/1976 Watts ..... E21B 4/18 175/102
5,224,548 A * 7/1993 Dankovich, II ..... E21B 7/006 166/99

(Continued)

FOREIGN PATENT DOCUMENTS

BR 112017021082 7/2022
CA 2980242 10/2016

(Continued)

OTHER PUBLICATIONS

Norwegian Search Report for NO 20181205, dated Jan. 29, 2019.
International Search Report and the Written Opinion for PCT/EP2019/074080, dated Nov. 25, 2019.

*Primary Examiner* — Shane Bomar
(74) *Attorney, Agent, or Firm* — Andrus Intellectual Property Law, LLP

(57) ABSTRACT

A well tool for removing metal debris from a well bore has a magnet element, an anti-torque anchor, a debris removal unit, a debris container and a first connecting end for a rotatable well string. The magnet element has a cylinder-shaped housing. The removal unit has a helix-shaped longitudinal guide element arranged on the housing. The anchor is connected to the housing or the guide element such that actuation of the anchor during use will prevent rotation of the housing or the guide element, respectively, relative the well-bore. The container has an opening at the end of the housing. The housing and the guide element are rotatable relative each other, and configured such that metal debris accumulating on the housing during use is guided by the guide element towards the opening of the container when the anchor is actuated and the first connecting end is rotated.

20 Claims, 11 Drawing Sheets

(51) Int. Cl.

| | |
|---|---|
| ***E21B 31/06*** | (2006.01) |
| ***E21B 23/01*** | (2006.01) |
| ***E21B 37/04*** | (2006.01) |

(56) References Cited

U.S. PATENT DOCUMENTS

| | | | | |
|---|---|---|---|---|
| 6,695,058 | B1 | 2/2004 | French | |
| 7,174,957 | B1 * | 2/2007 | Jokhio | B03C 1/0332 166/107 |
| 10,240,417 | B2 | 3/2019 | Stangeland | |
| 10,858,900 | B2 * | 12/2020 | Haugland | E21B 37/00 |
| 11,480,032 | B2 * | 10/2022 | Garcia | E21B 31/06 |
| 2005/0274524 | A1 | 12/2005 | Silguero | |
| 2008/0023033 | A1 | 1/2008 | Potter | |
| 2010/0186945 | A1 | 7/2010 | Hagen | |
| 2010/0258289 | A1 | 10/2010 | Lynde et al. | |
| 2011/0284210 | A1 | 11/2011 | Hern et al. | |
| 2011/0285155 | A1 | 11/2011 | Nelson et al. | |
| 2013/0000884 | A1 | 1/2013 | Linklater | |
| 2014/0326510 | A1 | 11/2014 | Wessel | |
| 2015/0122480 | A1 * | 5/2015 | Sullivan | E21B 31/06 166/66.5 |
| 2016/0348467 | A1 * | 12/2016 | Watson | E21B 43/26 |
| 2018/0016860 | A1 * | 1/2018 | Stangeland | E21B 27/04 |

FOREIGN PATENT DOCUMENTS

| | | |
|---|---|---|
| CN | 104033127 | 9/2014 |
| CN | 104033127 | 10/2016 |
| DE | 10331022 | 9/2004 |
| EA | 15116 | 6/2011 |
| EP | 2505768 | 10/2012 |
| EP | 3277917 | 6/2019 |
| NO | 338348 | 8/2016 |
| RU | 2004770 | 12/1993 |
| RU | 2690587 | 6/2019 |
| SA | 517390043 | 6/2022 |
| UA | 90427 | 5/2014 |
| WO | 2013189549 | 12/2013 |
| WO | 2014/133393 | 9/2014 |
| WO | 2014133393 | 9/2014 |
| WO | 2016/155852 | 10/2016 |
| WO | 2016155852 | 10/2016 |

* cited by examiner

Fig. 4 (Detail B)

Fig. 5 (Detail C)

Fig. 6 (Detail D)

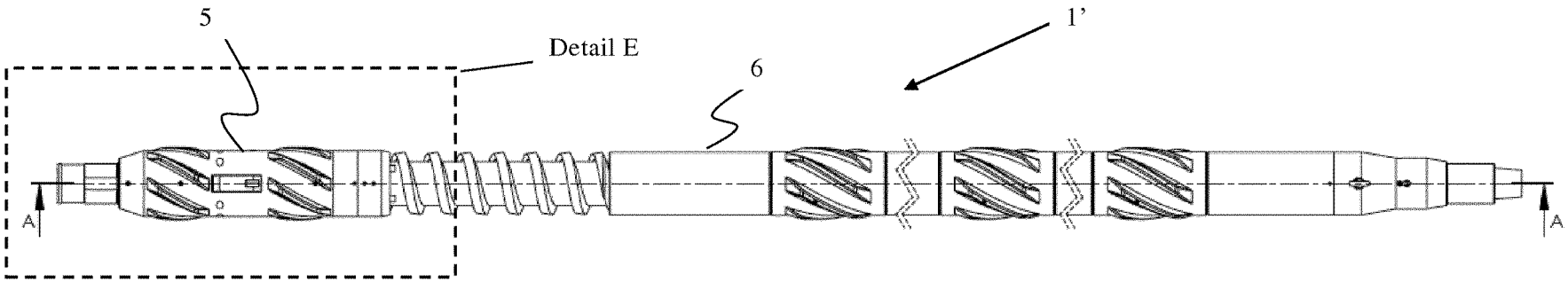
Fig. 8
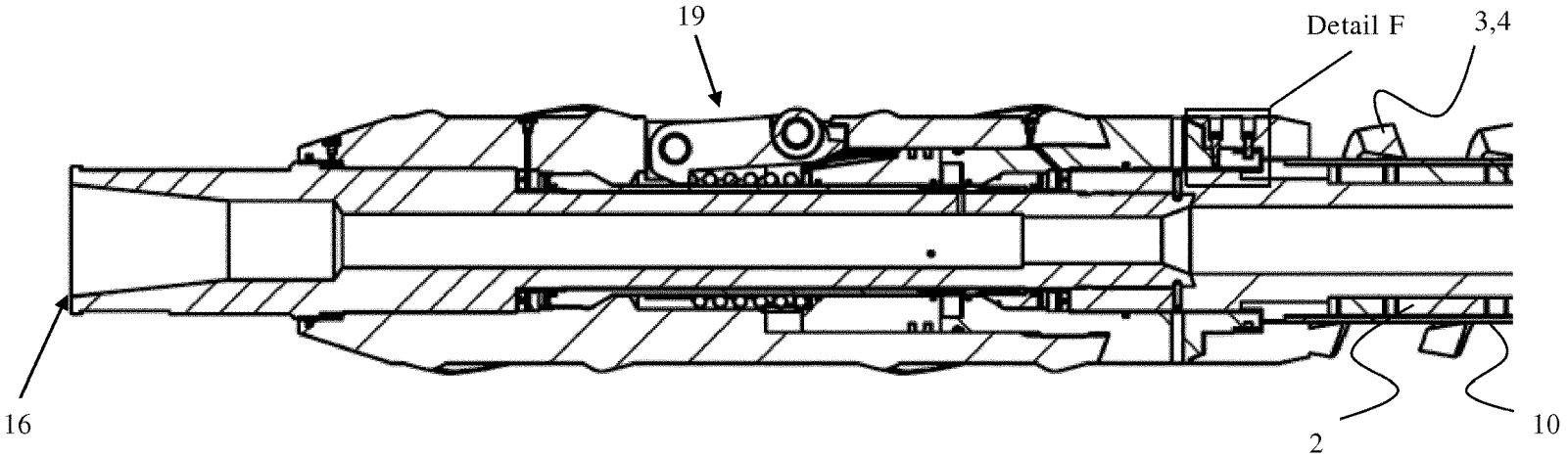
Fig. 9 (section A-A, detail E)

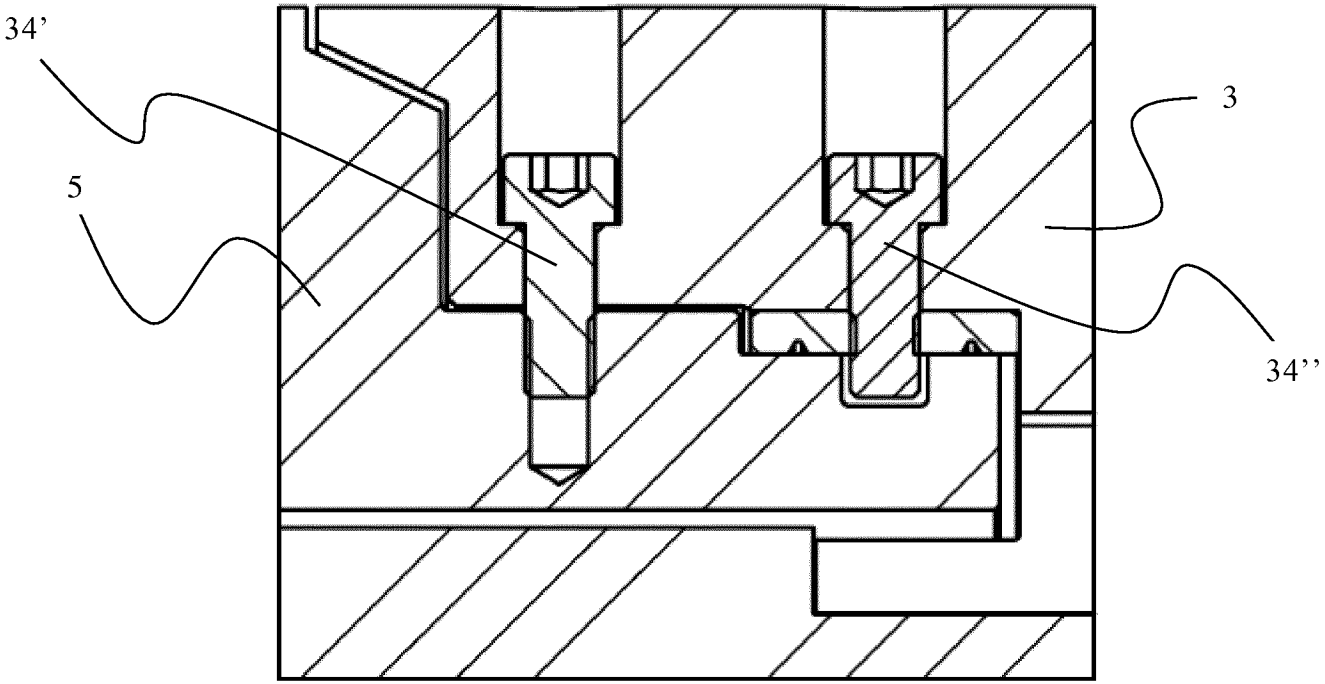
Fig. 10 (Detail F)

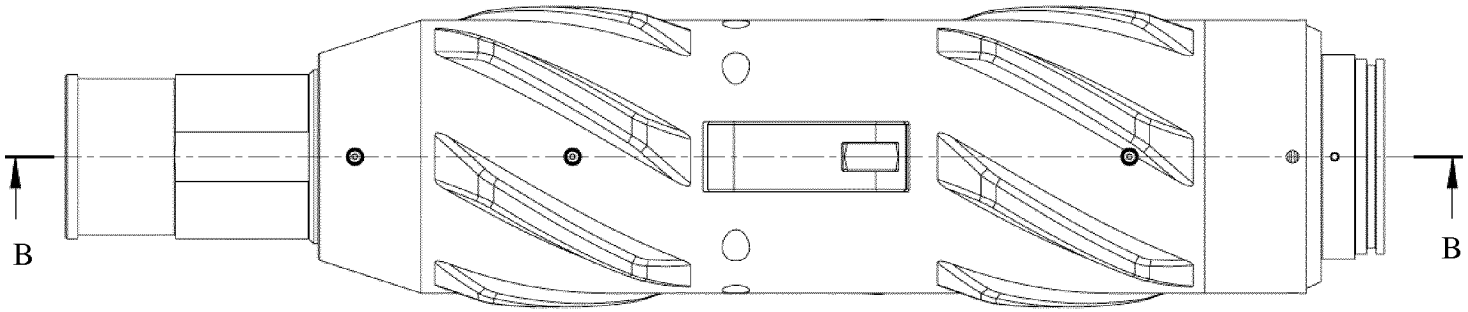
Fig. 11
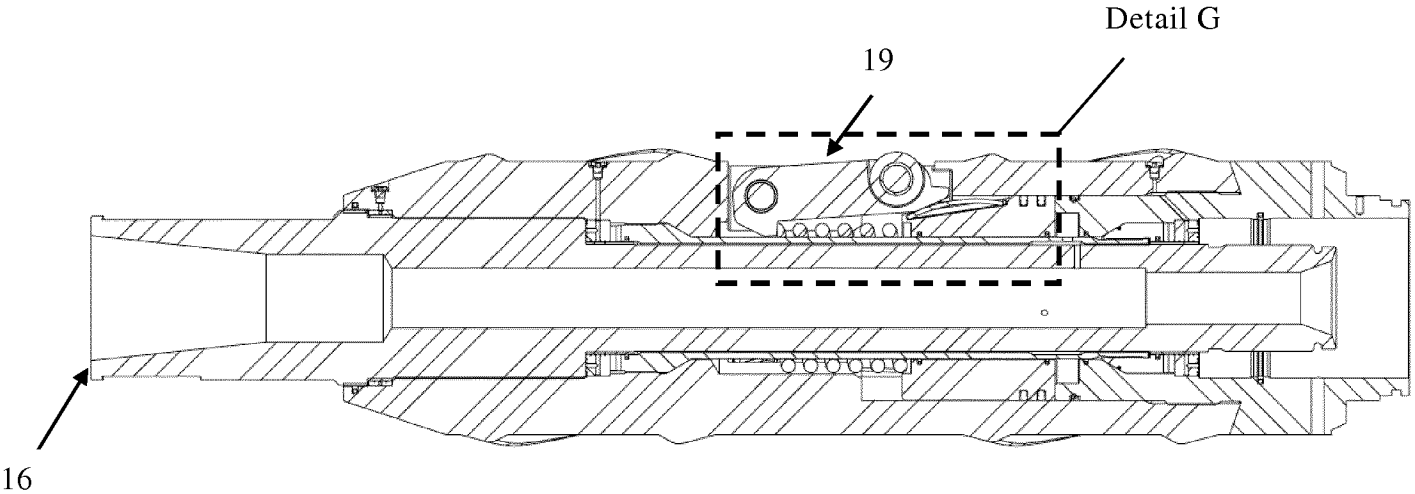
Fig. 12 (Section B-B)

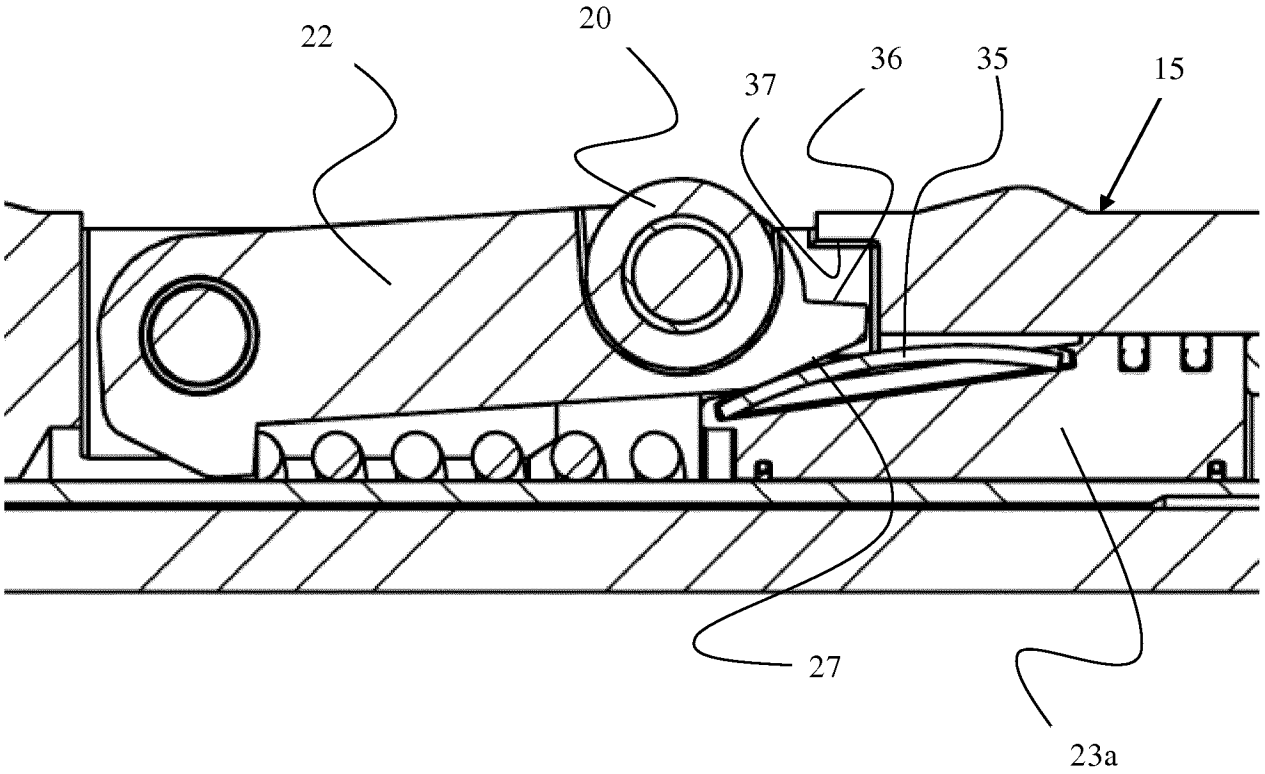
Fig. 13 (Detail G)

WELL TOOL

CROSS-REFERENCE TO RELATED APPLICATIONS

This application is the U.S. national stage application of International Application PCT/EP2019/074080, filed Sep. 10, 2019, which international application was published on Mar. 26, 2020, as International Publication WO 2020/058039 in the English language. The International Application claims priority of Norwegian Patent Application No. 20181205, filed Sep. 17, 2018. The international application and Norwegian application are both incorporated herein by reference, in entirety.

TECHNICAL FIELD

The present invention concerns the field of metal debris removal, and more particularly a well tool for removal of metal debris from a well bore.

BACKGROUND

In connection with certain well bore operations such as drilling, milling etc. it is required to perform clean-up operations to remove metal debris, i.e. metal chips, shavings remaining in the well. Such debris may otherwise interfere with the proper function of the Blow-Out Preventer (BOP), or other valves present in the well. Metal debris must also be removed before a depleted well is finally plugged to avoid metal debris in the cement plug.

Presently, metal debris is commonly removed by running a downhole magnet into the well. Metal debris is attracted to the magnet. When the magnet has attracted a certain amount of metal debris its magnetic field is weakened and is no longer able to attract further debris. To continue the clean-up operation, the magnet must be returned topside to manually remove the metal debris. After debris removal, the magnet may again be run into the well.

After certain well operations, it is necessary to clean the well of metal debris. The requirement may for instance be that less than 0.5 kg of metal debris should remain in the well after clean-up. To fulfil such requirements, a prior art downhole magnet must commonly be run into the well, and returned topside, multiple times. Such operations are time consuming and, consequently, very costly.

WO 2014/133393 A1 discloses a well tool for removal of magnetic debris in a BOP and marine riser.

Well tools using helical impellers for removing debris from a well bore are disclosed in for instance US 2008/023033 A1, U.S. Pat. No. 6,695,058 B1 and CN 104033127 A.

WO 2016/155852 A1 discloses a well tool for removing metal debris from a well bore. The tool is described using a dedicated motor or rotary nozzle assembly for providing rotation between a cylinder-shaped magnetic element and a helical scrape.

The goal of the present invention is to provide a tool for removal of metal debris, which would alleviate or avoid at least some of the disadvantages of the prior art methods and tools.

SUMMARY OF THE INVENTION

The present invention is defined by the appended claims and in the following:

In a first aspect, the invention provides a well tool for removing metal debris from a well bore, comprising a magnet element, an anti-torque anchor, a debris removal unit, a debris container and a connecting end for a rotatable well string, wherein the magnet element comprises a cylinder-shaped housing having a first end and a second end;

the debris removal unit comprises a helix-shaped longitudinal guide element arranged around the cylinder-shaped housing;

the anti-torque anchor is operably connected to the cylinder-shaped housing or the helix-shaped longitudinal guide element, such that actuation of the anti-torque anchor during use will prevent rotation of the cylinder-shaped housing or the helix-shaped longitudinal guide element, respectively, relative the well-bore; and the debris container comprises an opening arranged at the second end of the cylinder-shaped housing, wherein the cylinder-shaped housing and the helix-shaped longitudinal guide element are rotatable relative each other around a centreline of the well tool and configured such that metal debris accumulating on the cylinder-shaped housing during use is guided by the helix-shaped longitudinal guide element towards the opening of the debris container when the anti-torque anchor is actuated, and the connecting end is rotated. The connecting end is preferably rotated by a well string operably connected to the connecting end and rotated.

In other words, when the torque anchor is actuated during use, the cylinder-shaped housing will rotate relative the helix-shaped longitudinal element, such that metal debris accumulating on the cylinder-shaped housing is guided by the helix-shaped longitudinal guide element towards the opening of the debris container.

In an embodiment of the well tool, the cylinder-shaped housing or the helix-shaped longitudinal guide element not operably connected to the anti-torque anchor is operably connected to the first connecting end, such that rotational movement of the connecting end is transferred to the cylinder-shaped housing or the helix-shaped longitudinal guide element, respectively.

In an embodiment of the well tool, the helix-shaped longitudinal guide is operably connected to the anti-torque anchor and the cylinder-shaped housing is operably connected to the connecting end.

In an embodiment of the well tool, the cylinder-shaped housing is connected to the debris container, such that the debris container may rotate relative the helix-shaped longitudinal guide when the anti-torque anchor is actuated, and the connecting end is rotated.

In an embodiment of the well tool, the debris container is arranged to co-rotate with the cylinder-shaped housing.

The first connecting end is suitable for connecting the well tool to a rotatable well string, such as a drill pipe or any other well tool able to provide rotational movement to the connecting end.

In an embodiment of the well tool, the anti-torque anchor comprises a sleeve assembly having multiple anchoring devices, each anchoring device may be actuated from a first position to a second position, in the second position the anchoring device is radially extended relative the first position such that the multiple anchoring devices are in contact with a wall of the well bore when actuated during use.

In other words, in the first position the anchoring device (e.g. a bore wall-contacting portion of the anchoring device) is closer to a centerline of the sleeve assembly relative to the second position. In the second position, the anchoring device (e.g. the bore wall-contacting portion of the anchoring device) is extended away from the centerline of the sleeve assembly and into contact with the wall of a well bore.

In an embodiment of the well tool, each anchoring device comprises a wall-contacting portion. The wall-contacting portion may be any element able to substantially prevent or hinder rotational movement of the anti-torque anchor relative the well bore, such as a roller device. The wall-contacting portion is preferably a roller device arranged such that the anti-torque anchor, and consequently the well tool, may be moved in a longitudinal direction of the well bore while a rotational movement of the anti-torque anchor is substantially prevented or hindered.

The multiple anchoring elements may be evenly arranged around the sleeve assembly.

In an embodiment of the well tool, each of the anchoring devices comprises a roller device arranged to be in contact with a wall of the well bore when the anchoring devices are in the second position. The roller device features an axis of rotation substantially perpendicular to a centreline of the well tool, the roller device is preferably a wheel.

In an embodiment of the well tool, each of the anchoring devices comprises at least one arm being pivotably connected to the sleeve assembly and operably connected to a piston, such that actuation of the piston will move the anchoring device into the second position.

In an embodiment of the well tool, the at least one arm features a stop portion at an end opposite an end being pivotably connected to the sleeve assembly, and the sleeve assembly features a cooperating stop portion arranged to interact with the stop portion of the at least one arm when the arm is in the second position. The interacting stop portions preventing the at least one arm from radially extending beyond the second position. The stop portion of the arm may alternatively be termed a first interacting surface and the stop portion of the sleeve assembly a second interacting surface.

In other words, the piston is arranged to move the anchoring device into the second position In an embodiment of the well tool, the arm is operably connected to a spring, the spring biasing the anchoring device towards the first position.

In an embodiment of the well tool, the piston comprises an elastic element for interaction with the at least one arm, preferably the elastic element is a leaf spring.

In an embodiment of the well tool, the at least one arm is operably connected to the piston via the elastic element.

In an embodiment of the well tool, the elastic element comprises a surface of the piston arranged to interact with the anchoring device or arm.

The elastic element is arranged such that a force applied by the piston to the anchoring device may not exceed a set maximum force. The maximum force being decided by the properties of the elastic element.

In an embodiment of the well tool, the anti-torque anchor is connected to the debris removal unit by at least one shear bolt.

In other words, the anti-torque anchor is connected to the debris removal unit such that the connection between the anti-torque anchor and the debris removal unit may be severed if the scrape of the debris removal unit is stuck during use.

In an embodiment, the well tool comprises at least one tube element aligned around the centreline of the well tool and extending through the anti-torque anchor and the cylinder-shaped housing.

In an embodiment of the well tool, the at least one tube element extends through the anti-torque anchor the cylinder-shaped housing and the debris container.

In other words, the at least one tube element extends around a centerline of the anti-torque anchor, the cylinder-shaped housing and/or the debris container.

In an embodiment of the well tool, the connecting end is rigidly connected to the at least one tube element. In use, the well tool is substantially vertical, and the connecting end is arranged at an uppermost end of the well tool In an embodiment of the well tool, the connecting end is arranged at one end of the at least one tube element. preferably at one end of a tube element extending through the anti-torque anchor.

In other words, the sleeve assembly is rotatable relative the at least one tube element extending through the sleeve assembly, or alternatively through the anti-torque anchor. In this manner, the at least one tube element may be rotated by a rotatable well string connected to the connecting end, while the sleeve assembly is rotationally fixed by the anchoring elements.

In an embodiment, the well tool comprises a central bore made up of, or alternatively defined by, the at least one tube element.

In an embodiment of the well tool, the central bore extends from the first connecting end to the debris container. The central bore may be a through bore, i.e. a bore extending through the well tool or a blind bore, i.e. a bore extending from the connecting end and partially through the length of the well tool.

In an embodiment, the well tool comprises a second connecting end for optional connection to any suitable auxiliary well tool, such as a milling tool. The second connecting end may be arranged at the opposite end of the central bore, or the at least one tube element, relative the first connecting end. In use, the second connecting end is arranged at the lower end of the well tool.

In an embodiment of the well tool, the first connecting end is in fluid communication with the central bore of the well tool.

In an embodiment of the well tool, the piston is actuated by drilling mud from the central bore.

In an embodiment of the well tool, the helix-shaped longitudinal guide element is operably connected to the anti-torque anchor (and rotatably connected to the at least one tube element via the anti-torque anchor), and the cylinder-shaped housing is rigidly connected to the at least one tube element, or vice versa.

In an embodiment of the well tool, the anti-torque anchor is rotatable around the centreline of the well tool relative the at least one tube element extending through the anti-torque anchor.

In an embodiment of the well tool, the anti-torque anchor comprises a piston, and the at least one tube element comprises at least one radial through-bore fluidly connected to a hydraulic chamber in the sleeve assembly, the hydraulic chamber arranged to provide hydraulic pressure to actuate the piston.

In an embodiment of the well tool, an end of the sleeve assembly (i.e. a lower end of the sleeve assembly when the well tool is in use, or an end of the sleeve assembly facing the debris container) is connected to the helix-shaped longitudinal guide element, such that actuation of the anti-torque anchor during use will prevent rotation of the helix-shaped longitudinal guide element relative the well-bore.

In an embodiment of the well tool, the debris container is cylinder-shaped, wherein the centreline of the debris container is aligned with the centreline of the cylinder-shaped housing of the magnet element.

In an embodiment of the well tool, the first connecting end and the debris container are arranged at opposite ends of the cylinder-shaped housing.

In an embodiment, the opening of the debris container faces in a direction towards the first connecting end.

The cylinder-shaped housing has a circumferential surface to which metal is attracted by a magnetic field, preferably created by magnets embedded below said surface.

In a second aspect, the present invention provides a method of removing metal debris from a well bore, comprising the steps of:

providing a well tool according to the first aspect;

connecting a rotatable well string to the connecting end;

lowering the well tool into the well bore;

actuating the anti-torque anchor; and rotating the well string to rotate the cylinder-shaped housing or the helix-shaped longitudinal guide element (i.e. the cylinder-shaped housing or the helix-shaped longitudinal guide element not operably connected to the anti-torque anchor) around a centreline of the well tool, such that metal debris accumulating on the cylinder-shaped housing is guided by the helix-shaped longitudinal guide element towards the opening of the debris container.

In an embodiment, the method comprises a step of providing pressurized drilling fluid to the connecting end to actuate the anti-torque anchor.

In a third aspect, the present invention provides an anti-torque anchor comprising any of the features defined for the anti-torque anchor of the well tool according to the first aspect.

The term "anti-torque anchor" may alternatively be replaced by "anti-rotation anchor".

The term "tube element" may alternatively be replaced by the term "pipe element".

The term "magnet element" is intended to mean an element comprising parts able to magnetically attract metal debris, such as metal shavings, particles, filings and chips.

The term "operably connected" is intended to define a connection between two features which ensures that a defined effect is obtained. In other words, the two features do not have to be in direct contact but may also be indirectly connected via intermediate elements/features.

BRIEF DESCRIPTION OF THE DRAWINGS

Embodiments of the present invention are described in detail by reference to the attached drawings:

FIG. 8 is a side view of a second exemplary well tool according to the invention.

FIG. 9 is a sectional view of detail E in FIG. 8.

FIG. 10 is an enlarged view of detail F in FIG. 9.

FIG. 11 is a side view of the anchor used in the well tool in FIG. 8.

FIG. 12 is a sectional view of the anchor in FIG. 11.

FIG. 13 is an enlarged view of detail G in FIG. 12.

DETAILED DESCRIPTION OF EMBODIMENTS OF THE INVENTION

The present invention provides a tool for removal of metal debris from a well, for instance debris lodged in, or in the vicinity of, a BOP. An exemplary embodiment of such a tool is described below with reference to the attached drawings.

Figure 1:
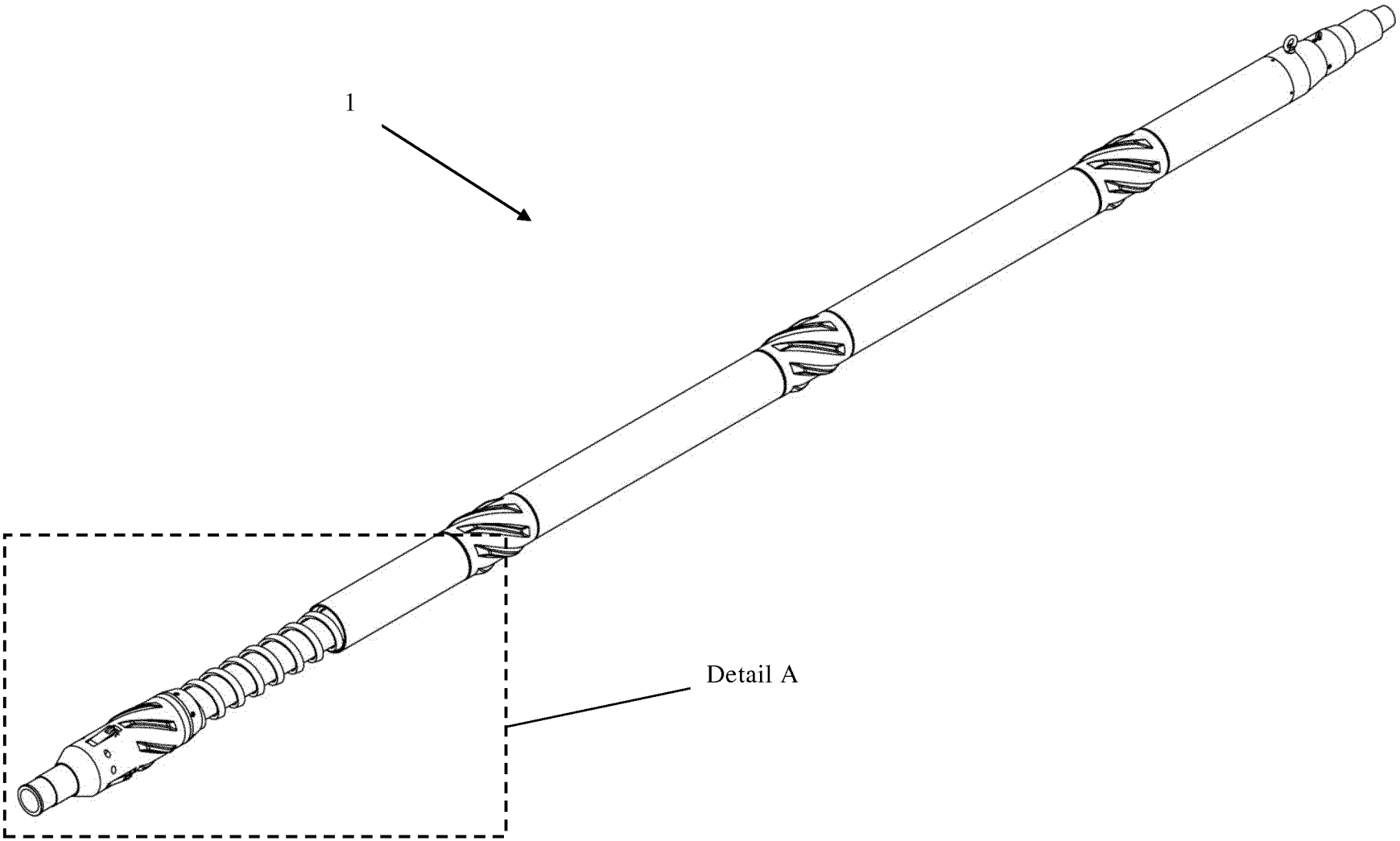
FIG. 1 is a perspective view of a first exemplary well tool according to the invention.
Figure 2:
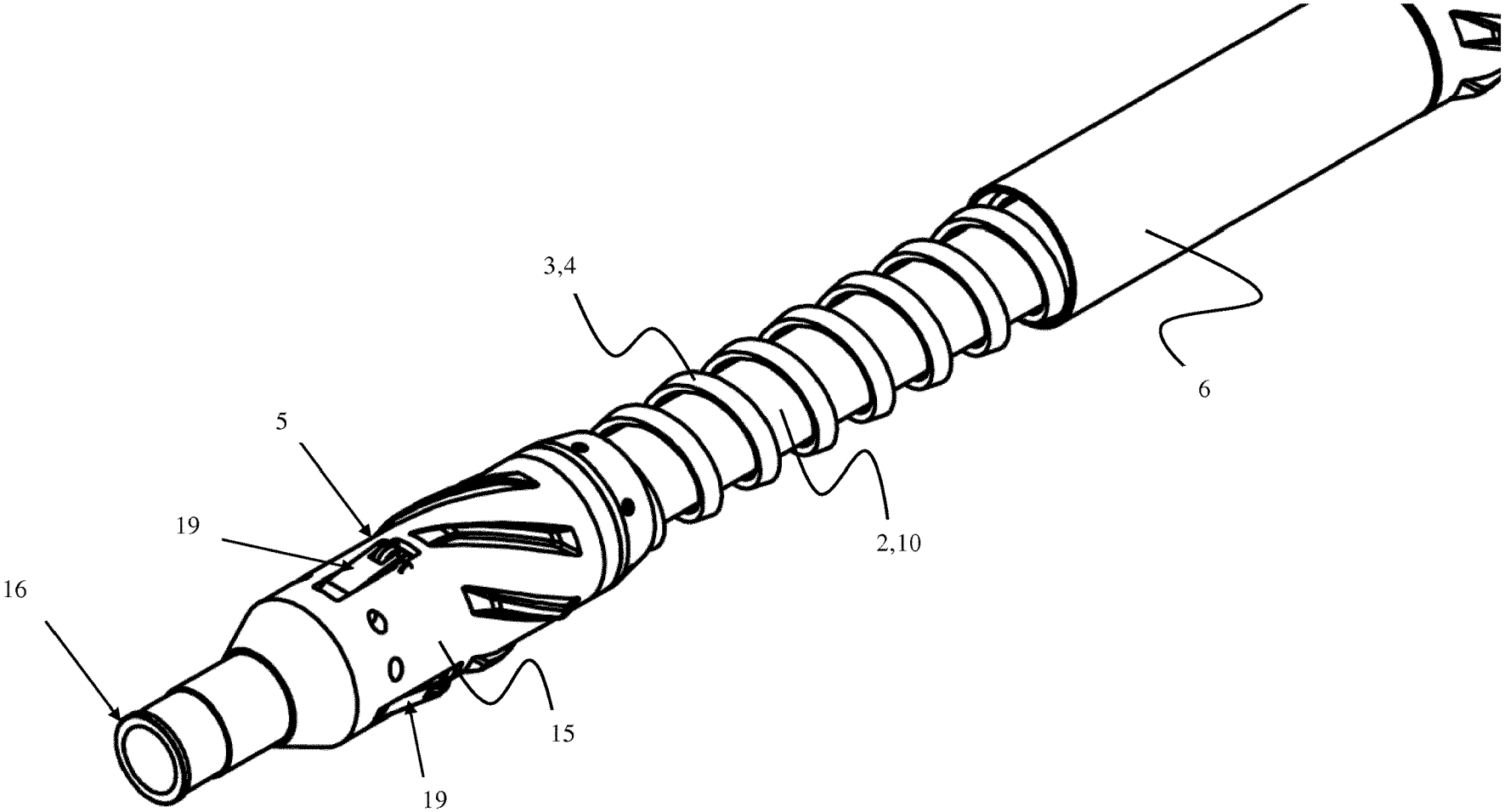
FIG. 2 is a perspective view of detail A of the well tool in FIG. 1.

A perspective view of a tool 1 according to the present invention is shown in FIG. 1 and an enlarged detailed view of the section of the tool comprising an anti-torque anchor is shown in FIG. 2.

Figure 3:
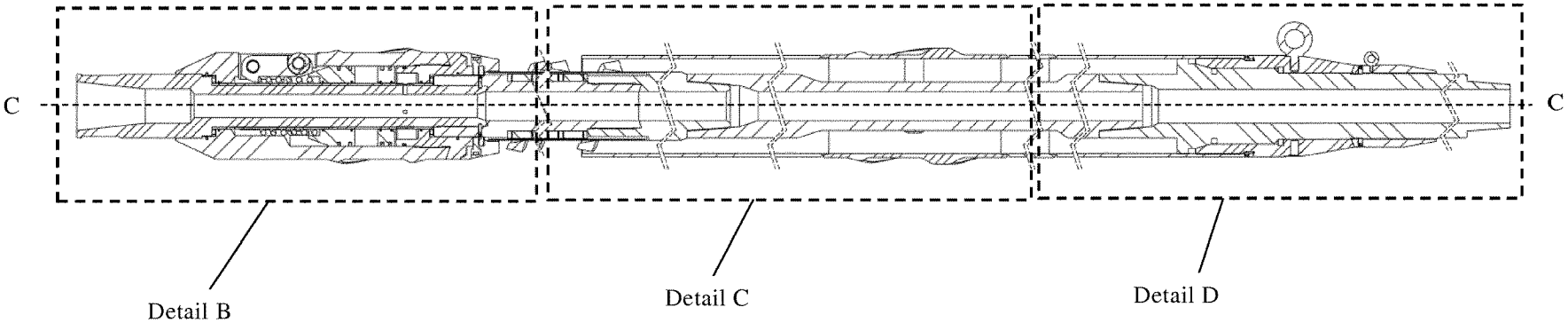
FIG. 3 is a cross-sectional view of the well tool in FIG. 1, the cross-section is along the centreline of the well tool.

FIG. 3 is a cross-sectional view of the well tool along the centreline C.

The well tool features a magnet element 2 for attracting metal debris, an anti-torque anchor 5, a debris removal unit 3, a debris container 6, a first connecting end 16 suitable for connection to a rotatable well string, and a second connecting end 33. The first connecting end may also be connected to a rotatable well string via a lower end of any other suitable well tool as long as a rotational movement may be provided to the connecting end. The second connecting end 33 may be connected to any suitable auxiliary well tool, such as a milling tool, if required.

Figure 4:
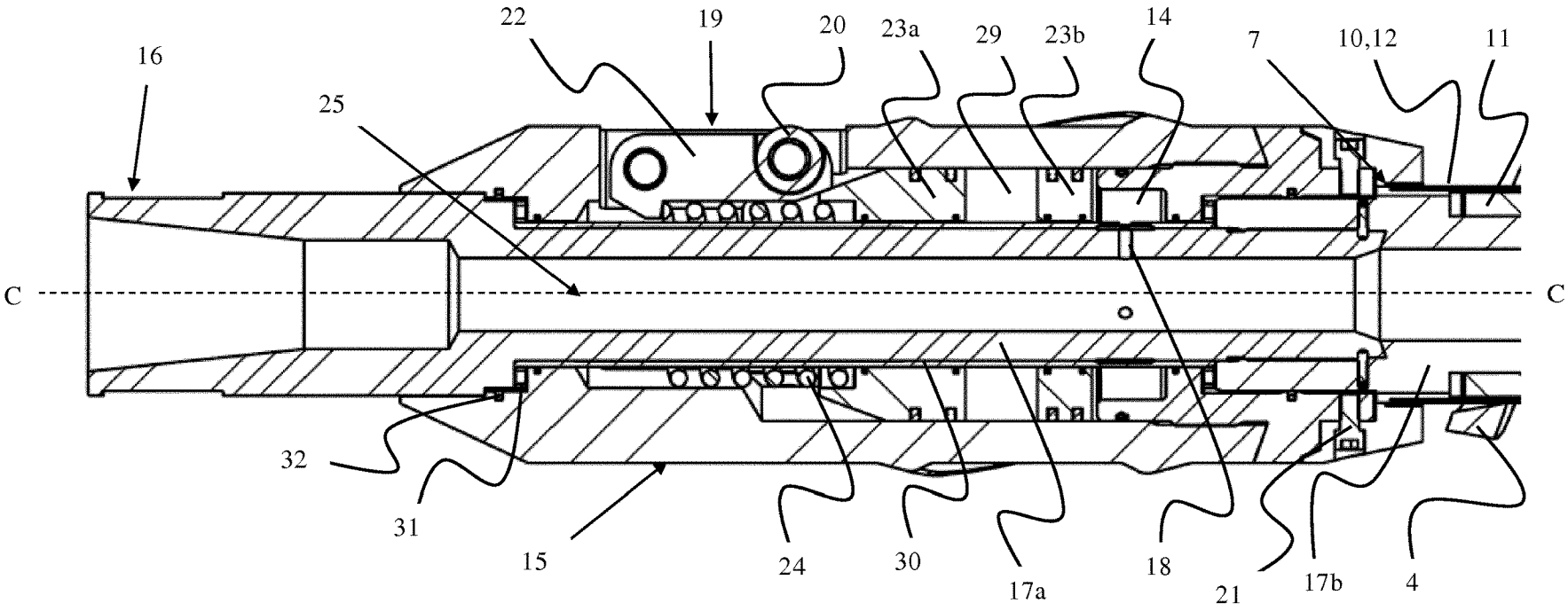
FIG. 4 is an enlarged view of detail B in FIG. 3.
Figure 5:
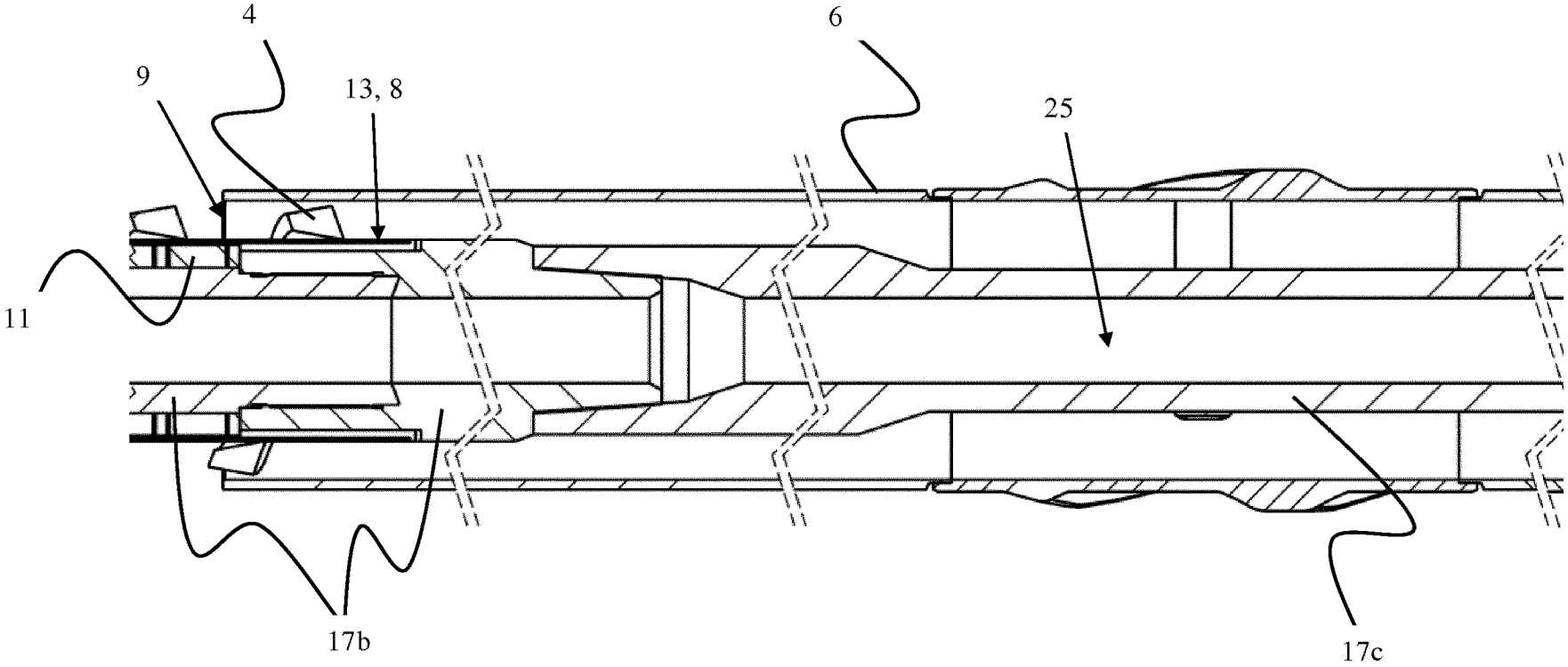
FIG. 5 is an enlarged view of detail C in FIG. 3.
Figure 6:
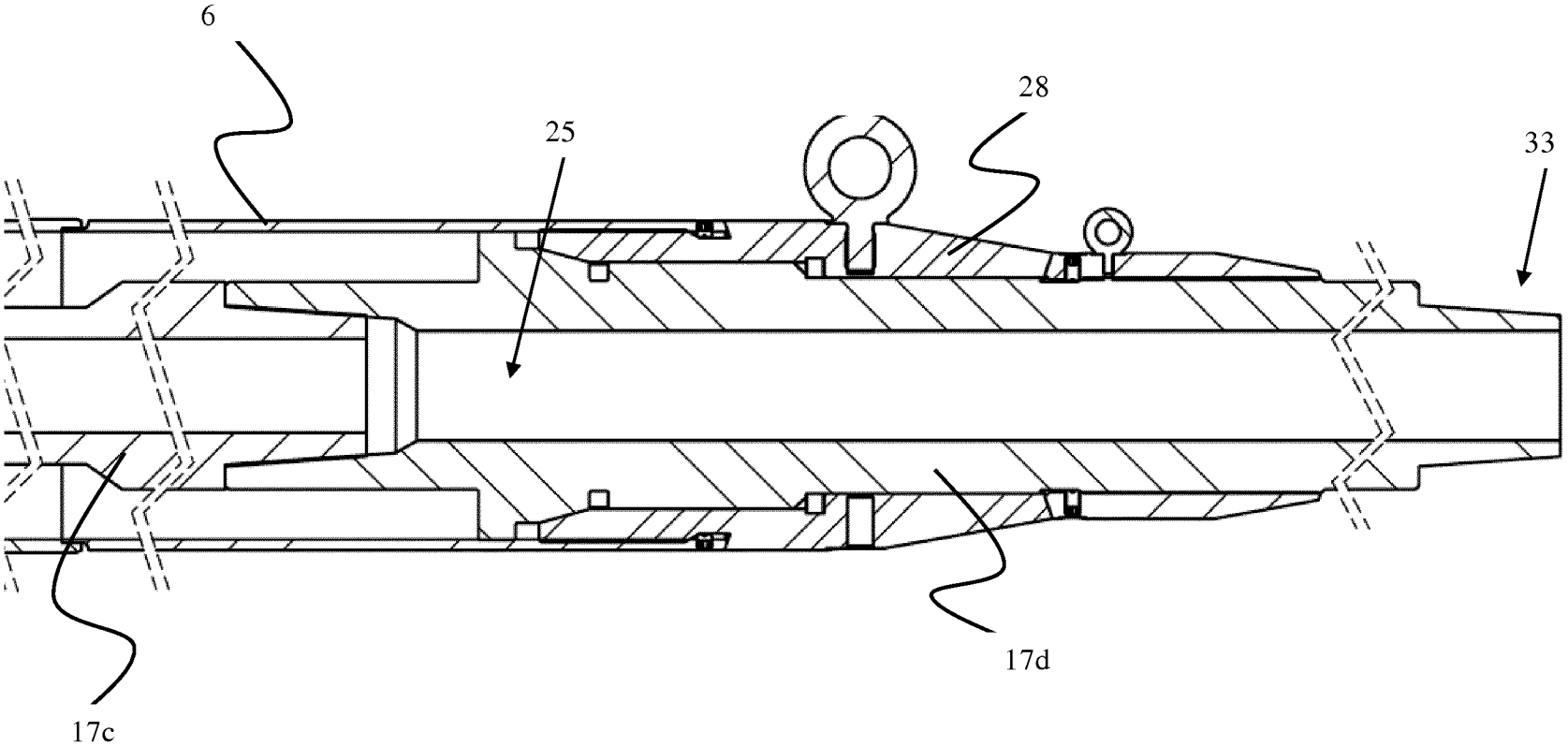
FIG. 6 is an enlarged view of detail D in FIG. 3.

The magnet element 2 have a cylinder-shaped housing 10 having a first end 7 and a second end 8. In the present embodiment, the cylinder-shaped housing 10 comprises multiple magnets 11, see FIGS. 4 and 5, embedded below the surface 12 of the housing. The magnets provide the required magnetic field for attracting metal debris. The magnetic field may be provided by any type of magnet assembly suitable for being embedded in or below the surface of the cylinder-shaped housing.

The debris removal unit 3 features a scrape 4 (i.e. a helix-shaped longitudinal guide element) arranged around the cylinder-shaped housing 10. The scrape 4 is arranged around and coaxial with the cylinder-shaped housing 10. An inner surface of the scrape (i.e. the surface turned towards a circumferential surface of the cylinder-shaped housing 10) is slightly spaced (0.1-0.5 mm) from a circumferential surface of the housing 10. The scrape 4 is preferably made in non-magnetic stainless steel, i.e. a suitable type of austenitic stainless steel.

The cylinder-shaped housing 10 and the scrape 4 is rotatable relative to each other around a centreline C of the well tool, such that metal debris accumulating on the cylinder-shaped housing 10 during use may be guided by the scrape 4 towards the opening 9 of the debris container 6 when the anti-torque anchor 5 is actuated and a well string connected to the connecting end is rotated.

An end section 13 of the magnet element has no, or a weakening, magnetic field in the direction of the second end 8 allowing for discharge of metal debris into the debris container 6 via an opening 9 arranged at the second end 8 of the cylinder-shaped housing 10. To ensure that most or all of the metal debris enters the debris container, the whole end section 13 is arranged inside the debris container, i.e. below the opening 9 of the debris container 6 when the well tool is vertically arranged.

Figure 7:
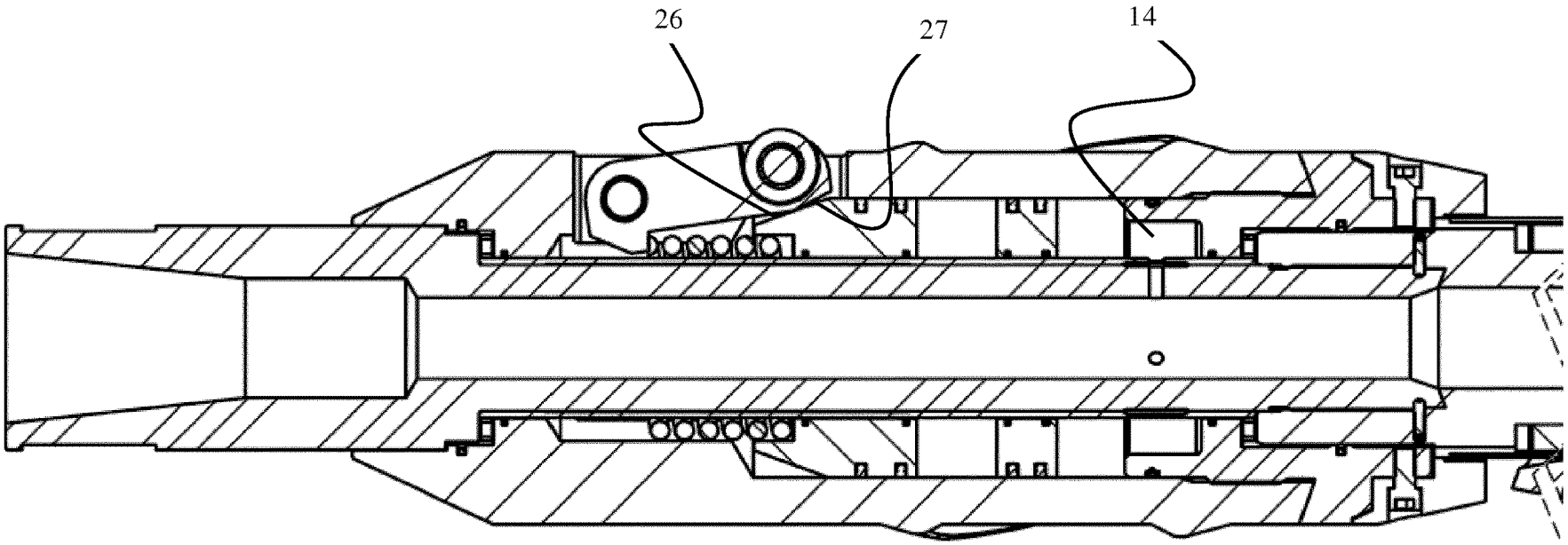
FIG. 7 is an enlarged view of the well tool section shown in FIG. 4, wherein the anti-torque anchor is actuated.

The anti-torque anchor 5 is connected to the scrape 4, such that actuation of the anti-torque anchor during use will rotationally fix the scrape 4 relative a well-bore in which the well tool is run. The anti-torque anchor comprises a sleeve assembly 15 having multiple anchoring devices 19. Each anchoring device features an arm 22 being pivotably connected to the sleeve assembly at a first end and connected to a wheel 20 (i.e. a wall-contacting portion or a roller device) at a second end. The arm 22 (or wheel 20) is biased into a first position by a spring and operably connected to an annular piston, such that actuation of the piston will move the wheel 20 from the first position to a second position, see FIGS. 4 and 7. The second position is radially extended relative the first position such that the wheels of the multiple anchoring devices may be brought into contact with the wall of a well bore during use. The wheels 20 ensure that rotation of the scrape is prevented when a well string connected to the connecting end is rotated, while at the same time allowing the well tool to be moved in a vertical direction within the well bore.

Thus, the cylinder-shaped housing 10 will rotate relative to the scrape 4 when the rotary sleeve is in motion. In use, the relative rotary motion between the scrape 4 and the cylinder-shaped housing 10 will cause the metal debris, attracted to and accumulated on the magnetic element, to be pushed towards and into the debris container 6. In this way, the strength of the magnetic field of the magnetic element will not be weakened over time due to accumulated metal debris, and it is therefore not required to bring the well tool topside for intermediate discharge/removal of metal debris until the operation is finished. Transport of the metal debris into the debris container 6 is further improved by having the debris container fixed to the cylinder-shaped housing 10, such that the debris container 6 rotates relative the scrape 4. The latter solution minimizes the formation of metal debris plugs or nesting at the opening 9 of the debris container.

Optional features of the magnet element 2, the scrape and the debris container are disclosed in WO 2016/155852 A1, and such features are hereby incorporated by reference.

In the present embodiment, the well tool 1 comprises a central bore 25 made up of multiple tube elements 17*a-d* (or pipes) which are coaxially arranged with the anti-torque anchor, the cylinder-shaped housing 10, the scrape 4 and the debris container 6. The multiple tube elements are rigidly interconnected and will corotate around the centreline C of the well tool with a rotating well string connected to the connecting end.

In other embodiments, it is envisaged that a single tube may provide the central bore. However, the solution of having multiple tube elements is preferred as it facilitates manufacture, assembly and repair of the well tool.

The tube element 17*a*, extending through the sleeve assembly of the anti-torque anchor, has radial through-bores 18 fluidly connected to a hydraulic chamber 14 arranged at one end of a piston assembly 23*a*, 23*b* (i.e. a piston). The piston assembly comprises a first piston element 23*a* in contact with the arms 22 and a second piston element 23*b* in contact with the hydraulic chamber 14. The first and the second piston element are separated by a fluid-filled chamber 29 providing a dampening effect. During use of the well tool 1, pressurized drill fluid or mud enters the hydraulic chamber 14 and the piston assembly 23*a*, 23*b* is forced against the arms 22 of the anchoring devices 19. In this embodiment, the piston element 23*a* features an inclined surface 26 which interacts with a cooperating inclined surface 27 on the arm 22. The interaction of the cooperating inclined surfaces pushes the end of the arm featuring the wheel 20 into a radially extended position, i.e. into the second position, see FIG. 7. In the second position, the wheel is in contact with the wall of the well bore.

The sleeve assembly 15 is connected to the scrape 4 by bolts 21. By use of slide bearings 30, thrust bearings 31 and suitable seals 32 arranged between the sleeve assembly 15 and the tube element 17*a*, the sleeve assembly and the scrape are free to rotate relative the tube element 17*a* and the cylinder-shaped housing 10.

The debris container 6 is rigidly connected to the tube element 17*d* extending through an end section of the debris container 6 via a connecting sleeve 28.

A second exemplary well tool 1' is shown in FIGS. 8-10 and the anchor section of the well tool shown separate in FIGS. 11-13.

The well tool 1' in FIGS. 8-10 comprises the same main technical features, and functions in the same manner, as the well tool 1 in FIGS. 1-7. Identical reference numbers are used for features being in common for the two exemplary well tools.

A side view of the well tool is shown in FIG. 8 and a sectional view of the anchor section, i.e. detail F, is shown in FIG. 9. In view of the first exemplary well tool, the second exemplary well tool comprises two distinguishing technical features.

The first distinguishing feature is shown in FIGS. 9 and 10. The debris removal unit 3, including the scrape 4, is connected to the anti-torque anchor 5 via shear bolts or pins 34',34". Shear bolts or pins are designed to provide a clean break when subjected to shear forces extending a set value. The purpose of having the scrape 4 connected to the anti-torque anchor 5 in this manner is to ensure that the well tool is not unnecessarily damaged if the scrape 4 becomes stuck or the rotational movement between the scrape 4 and the cylinder-shaped housing 10 is prevented during use. Without the shear bolts/pins, the collateral damage to the anti-torque anchor and other parts of the well tool may be substantial if the scrape 4 is stuck.

The second distinguishing feature is shown in FIGS. 12 and 13. In the second exemplary well tool, the piston 23*a*, used to move the wheel 20 on the arm 22 of the anti-torque anchor 5 into the second position as described above, features a leaf spring 35 at the end of the piston 23*a* which interacts with the arms 22. The leaf spring 35 ensures that the force by which the wheels 20 is pushed against the wall of a well bore casing does not exceed a maximum value. The maximum value may be set by selecting a leaf spring 35 having a desired spring constant and displacement. The feature of having a leaf spring 35 on the piston 23*a* may be advantageous when the well tool 1' is used together with a hydraulic whipstock for deflecting the direction of the well tool. Hydraulic whipstocks often require a hydraulic pressure of about 220 bars to be set within the well bore, and the resulting pressure on the wheels 20 of the anti-torque anchor 5 may be too high, e.g. causing damage to the well bore casing. In situations wherein a mechanical whipstock is used, the hydraulic pressure may be held at a lower level and a leaf spring is not necessarily required. Although the use of leaf springs is believed to be the most functional solution, in other embodiments the leaf springs may be replaced by alternative elastic elements, such as a plate supported by coil springs or similar assemblies. In the second exemplary embodiment, the arm 22 comprises a first interacting surface 36 arranged to abut against a second interacting surface 37 on the sleeve assembly 15 when the arm is in the second position, i.e. preventing the arm from extending beyond the second position. Having the radial extent obtained in the second position restricted by the interacting surfaces 36,37 is advantageous in particular when the well tool is used together with an hydraulic whipstock.

Specific solutions for extending the anchoring devices 19 is shown in connection with the exemplary well tools in FIGS. 1-13. However, based on the present disclosure, the skilled person would easily recognize numerous alternative solutions for obtaining a hydraulic, or even electric, actuation of the anchoring devices.

In the exemplary well tools of FIGS. 1-13, the cylinder-shaped housing 10 is rotated by use of a rotatable well string connected to the first connecting end 16, while the surrounding scrape 4 is rotatably fixed by being connected to the anti-torque anchor, thus obtaining a rotational movement between the cylinder-shaped housing 10 and the scrape 4. In other embodiments, the rotational movement may be obtained by an opposite solution, i.e. rotation of the scrape while the cylinder-shaped housing is fixed. The latter effect may for instance be obtained by having an anti-torque anchor arranged at the debris container 6 to rotatably fix the debris container 6 and the cylinder-shaped housing relative a well bore and a tube element extending through the well tool, and by having the connecting end operably connected to the scrape. The anti-torque anchor may for instance be incorporated in the connecting sleeve 28. In this manner, a rotating well string will cause the scrape to rotate relative both a well bore and the cylinder-shaped housing providing the same effect as in the exemplary well tool.

The invention claimed is:

1. A well tool for removing metal debris from a well bore, comprising a magnet element, an anti-torque anchor, a debris removal unit, a debris container and a first connecting end for a rotatable well string, wherein the magnet element comprises a cylinder-shaped housing having a first end and a second end;

the debris removal unit comprises a helix-shaped longitudinal guide element arranged around the cylinder-shaped housing;

the anti-torque anchor is operably connected to the cylinder-shaped housing or the helix-shaped longitudinal guide element, such that actuation of the anti-torque anchor during use will prevent rotation of the cylinder-shaped housing or the helix-shaped longitudinal guide element, respectively, relative the well-bore; and the debris container comprises an opening arranged at the second end of the cylinder-shaped housing, wherein the cylinder-shaped housing and the helix-shaped longitudinal guide element are rotatable relative each other around a centerline of the well tool, and configured such that metal debris accumulating on the cylinder-shaped housing during use is guided by the helix-shaped longitudinal guide element towards the opening of the debris container when the anti-torque anchor is actuated and the first connecting end is rotated.

2. The well tool according to claim 1, wherein the cylinder-shaped housing or the helix-shaped longitudinal guide element which is not operably connected to the anti-torque anchor is operably connected to the first connecting end, such that rotational movement of the first connecting end is transferred to the cylinder-shaped housing or the helix-shaped longitudinal guide element, respectively.

3. The well tool according to claim 1, wherein the anti-torque anchor comprises a sleeve assembly having multiple anchoring devices, each anchoring device may be actuated from a first position to a second position, in the second position the anchoring device is radially extended relative the first position such that the multiple anchoring devices may be in contact with a wall of the well bore when actuated during use.

4. The well tool according to claim 3, wherein each of the anchoring devices comprises a roller device arranged to be in contact with a wall of the well bore when the anchoring devices are in the second position, the roller device features an axis of rotation substantially perpendicular to a centerline of the well tool.

5. The well tool according to claim 3, wherein each of the anchoring devices comprises at least one arm being pivotably connected to the sleeve assembly and operably connected to a piston, such that actuation of the piston will move the anchoring device into the second position.

6. The well tool according to claim 5, wherein the at least one arm is operably connected to a spring, the spring biasing the anchoring devices towards the first position.

7. The well tool according to claim 5, wherein the piston comprises an elastic element for interaction with the at least one arm, preferably the elastic element is a leaf spring.

8. The well tool according to claim 1, wherein the anti-torque anchor is connected to the debris removal unit by at least one shear bolt.

9. The well tool according to claim 1, comprising at least one tube element aligned around the centerline of the well tool and extending through the anti-torque anchor and the cylinder-shaped housing.

10. The well tool according to claim 9, wherein the first connecting end is arranged at one end of the at least one tube element.

11. The well tool according to claim 9, comprising a central bore made up of the at least one tube element.

12. The well tool according to claim 11, wherein the first connecting end is in fluid communication with the central bore.

13. The well tool according to claim 11, wherein the piston is actuated by drilling mud from the central bore.

14. The well tool according to claim 13, wherein the at least one tube element comprises at least one radial through-bore fluidly connected to a hydraulic chamber in the sleeve assembly, the hydraulic chamber arranged to provide hydraulic pressure to actuate the piston.

15. A method of removing metal debris from a well bore, comprising the steps of:

providing a well tool according to claim 1;

connecting a rotatable well string to the first connecting end:

lowering the well tool into the well bore;

actuating the anti-torque anchor; and rotating the well string to rotate the cylinder-shaped housing or the helix-shaped longitudinal guide element around a centerline of the well tool, such that metal debris accumulating on the cylinder-shaped housing is guided by the helix-shaped longitudinal guide element towards the opening of the debris container.

16. The method according to claim 15, wherein the anti-torque anchor is actuated by providing pressurized drilling fluid to the first connecting end.

17. The well tool according to claim 2, wherein the anti-torque anchor comprises a sleeve assembly having multiple anchoring devices, each anchoring device may be actuated from a first position to a second position, in the second position the anchoring device is radially extended relative the first position such that the multiple anchoring devices may be in contact with a wall of the well bore when actuated during use.

18. The well tool according to claim 4, wherein each of the anchoring devices comprises at least one arm being pivotably connected to the sleeve assembly and operably connected to a piston, such that actuation of the piston will move the anchoring device into the second position.

19. The well tool according to claim 6, wherein the piston comprises an elastic element for interaction with the at least one arm, preferably the elastic element is a leaf spring.

20. The well tool according to claim 10, comprising a central bore made up of the at least one tube element.

* * * * *